United States Patent [19]

Ilnyckyj

[11] 4,147,520

[45] Apr. 3, 1979

[54] COMBINATIONS OF OIL-SOLUBLE ALIPHATIC COPOLYMERS WITH NITROGEN DERIVATIVES OF HYDROCARBON SUBSTITUTED SUCCINIC ACIDS ARE FLOW IMPROVERS FOR MIDDLE DISTILLATE FUEL OILS

[75] Inventor: Stephen Ilnyckyj, Maplewood, N.J.

[73] Assignee: Exxon Research & Engineering Co., Florham Park, N.J.

[21] Appl. No.: 777,960

[22] Filed: Mar. 16, 1977

[51] Int. Cl.[2] ..... C10L 1/22

[52] U.S. Cl. ..... 44/62; 44/70; 44/71

[58] Field of Search ..... 44/70, 62, 71

[56] References Cited

U.S. PATENT DOCUMENTS

| | | | |
|---|---|---|---|
| 3,444,082 | 5/1969 | Kautsky | 44/62 |
| 3,846,093 | 11/1974 | Feldman | 44/70 |
| 3,961,916 | 6/1976 | Ilnyckyj | 44/62 |

*Primary Examiner*—Winston A. Douglas
*Assistant Examiner*—Y. Harris-Smith
*Attorney, Agent, or Firm*—Roland A. Dexter

[57] ABSTRACT

Combinations of an oil-soluble aliphatic copolymer having the property of a nucleator for wax crystallization e.g., an ethylene-vinyl acetate copolymer having a number average molecular weight within the range of 500–50,000, in combination with an oil-soluble hydrocarbyl substituted succinic acid which has been reacted with a nitrogen material to form either an amine salt or an amide or a mixture thereof wherein the hydrocarbyl groups contain 8 to 28, preferably 12 to 22, carbon atoms are useful in improving the cold flow properties of distillate hydrocarbon oils.

2 Claims, No Drawings

COMBINATIONS OF OIL-SOLUBLE ALIPHATIC COPOLYMERS WITH NITROGEN DERIVATIVES OF HYDROCARBON SUBSTITUTED SUCCINIC ACIDS ARE FLOW IMPROVERS FOR MIDDLE DISTILLATE FUEL OILS

BACKGROUND OF THE INVENTION

1. Field of the Invention

The invention relates to an additive combination of an oil-soluble aliphatic copolymer having the property of a nucleator for wax crystallization e.g., an ethylene-vinyl acetate copolymer, with an oil-soluble hydrocarbyl substituted succinic acid which has been reacted with a nitrogen material to form a derivative thereof. This combination is particularly useful in distillate fuel oil having a final boiling point above about 370° C. and also having an undesirable property of supercooling which reduces the effectiveness of wax growth arresters in preventing the formation of large wax crystals.

2. Description of the Prior Art

Middle distillates containing normal paraffins have the characteristic of losing their fluidity rather suddenly as the temperature of the oil is decreased. This loss of fluidity is due to the crystallization of the normal paraffins into plate-like wax crystals which eventually form a spongy mass entrapping the oil therein.

Generally, the process of crystallization occurs through supercooling of a liquid phase which can be either a melt or a solution. The degree of supercooling necessary for onset of crystallization varies considerably depending on the nature of the system. In order to arrest the growth of wax crystals in petroleum fractions, the arresting is conventionally accomplished by use of additive compounds defined as wax growth arresters. The ease or facility of arresting the growth of wax crystals is functionally inversely related to the magnitude of supercooling of the petroleum fraction before onset of crystallization, i.e. the closer crystallization occurs to the saturation temperature, the more effective will be the growth arrester. For this reason, one seeks to discover compounds which exceptionally reduce said magnitude of supercooling, as nucleators for wax crystallization thereby facilitating the function of the growth arrester. These nucleation and growth arresting phenomena must not be confused with pour point depression.

In addition to this phenomenon described above the fluidity of distillates is impaired by their tendency to congeal due to wax separation. This undesirable characteristic is overcome by the use of compounds referred to as pour depressants which function by being absorbed on the surface of the wax crystals and in so doing prevent oil gelation. The present inventive disclosure of this application does not relate to this aspect of low temperature fluidity of waxy distillate fuels.

It is also known that wax crystal modification is a variable phenomenon depending upon the particular petroleum product to be treated. Thus, the molecular size and structure of waxes in a particularly defined petroleum product will vary considerably, depending upon the type of crude oil and refining process utilized to arrive at that product. The effectiveness of the particular wax modifying material will vary from petroleum product to petroleum product.

The difference in the ability of a particular wax crystal modifier to affect a petroleum product is often referred to as the responsiveness of the treated product to the modifier. Thus, some petroleum products are much more responsive to wax crystal modifiers of a given type than another petroleum product would be to the same wax crystal modifier.

Moreover, wax crystal modifiers were generally considered to be polymeric materials, such as the classic ethylene vinyl acetate copolymer.

Recently, it has become known that pour point depression alone is not a sufficient phenomenon to alleviate some problems caused by wax crystals in various fuels, especially middle distillates. In those petroleum fractions, it has been observed that the wax crystals formed in the presence of the pour point depressant are often too large to enable the wax-cloudy fuels to pass easily through screens and orifices commonly encountered in the equipment employed either in distribution or in use of such fuels. This problem has been alleviated by the addition to said fraction of petroleum products of wax crystal modifiers which are referred to as flow and filterability improvers.

U.S. Pat. No. 3,961,916 teaches that the low temperature flow characteristics of petroleum middle distillates can be very satisfactorily controlled by the proper choice of a combination of a nucleating agent or wax growth stimulator and a wax crystal growth arrester. This was based on discovery that depending on its composition and physicochemical characteristics, such as molecular weight and branchiness, a polymeric wax crystal modifier can essentially operate as a nucleator or as a growth arrester for wax crystals. According to this patent, one convenient way of achieving this in a most effective way is to add a separate polymeric additive to effect each of the separate functionalities desired.

Another disclosure in the prior art is that of U.S. Pat. No. 3,444,082 which teaches that a combination of alkenyl succinamic acid and the amine salts thereof with ethylene copolymers are good for reducing the pour point of various petroleum fuels. These ethylene polymers are in preferred form said to contain polymethylene segments separated by a divider resulting from the presence of a comonomer copolymerized with the ethylene. Those comonomers include hydrocarbon terminal olefins of from about 3 to 12 carbon atoms and various heteroatom containing addition polymerizable terminal olefins such as the acrylates, methacrylates, vinyl ethers, vinyl ketones, vinyl esters, etc. (see col. 4, 11. 48–49 and Table IV).

Further, U.S. Pat. No. 3,850,587 teaches a three component flow-improver admixture for waxy hydrocarbonaceous fuels comprising: (1) a $C_8$ to $C_{28}$ hydrocarbyl succinamic acid mono- or disubstituted on the nitrogen atom with $C_8$ to $C_{28}$ hydrocarbyl groups; (2) an ethylene-vinyl acetate polymer containing from 10 to 40 weight percent vinyl acetate and having a molecular weight between 800 and about 10,000, and (3) an aromatic acid having from 7 to 20 carbons whereby the cold flow properties of distillate fuels are improved.

Summary of the Invention

It has been found that an oil-soluble aliphatic copolymer having the property of a nucleator for wax crystallization can be used in combination with a $C_8$ to $C_{28}$ hydrocarbyl succinamic acid mono- or disubstituted on the nitrogen atom with $C_8$ to $C_{28}$ hydrocarbyl groups or amine salts or amides derivative which are described hereafter to improve the cold flow characteristics of a distillate fuel oil having the property of supercooling so as to markedly improve the effectiveness of wax growth arresters in preventing the formation of large wax crystals.

In accordance with the present invention, a fuel composition is provided with comprises a major proportion, i.e., more than 50% by weight, of a distillate petroleum fraction and from about 0.001 to 0.5 wt. % of a flow and filterability improving composition comprising:

(a) 1–20 parts by weight of an oil-soluble aliphatic copolymer functioning as a nucleator for wax crystallization in said distillate, and;

(b) 1–100 parts by weight of an oil-soluble succinamic acid or its derivative having the following formula:

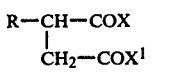

wherein: R is a straight chain aliphatic hydrocarbon group having from 0 to 1 site of olefinic unsaturation (alkyl or alkenyl) attached at a secondary carbon atom to the succinyl group and is of at least 8 carbon atoms, generally in the range of 14 to 28 carbon atoms and more usually in the range of 15 to 22 carbon atoms; one of X and $X^1$ is hydroxyl and the other is $$-NYY^1$$

wherein N has its normal meaning of nitrogen and Y and $Y^1$ are aliphatic hydrocarbyl groups of from 8 to 28 carbon atoms, more usually of from 14 to 22 carbon atoms, having a total of from about 30 to 52 carbon atoms, more usually of from 32 to 48 carbon atoms, and, preferably, of from 32 to 40 carbon atoms and the other of X and $X^1$ is of the formula:

$$OH(NHY^2Y^3)_n$$

wherein n varies from 0 to 1, $Y^2$ and $Y^3$ are selected from the class of hydrogen, an aliphatic hydrocarbon of from 1 to 30 carbon atoms and oxyaliphatic hydrocarbon of from 1 to 30 carbon atoms, and $Y^2$ and $Y^3$ may be taken together with the nitrogen to which they are attached to form a heterocyclic ring of from 5 to 7 annular members. It is preferred that the weight ratio of a/b is in the range of 1/20 to 5/1.

It has been found that said composition prevents oil gelation and effectively controls wax crystal size in distillate hydrocarbon oils having a final boiling point in excess of about 370° C.

Concentrates of 1 to 60 wt. % of said additive combination in 40 to 99 wt. % of mineral oil, e.g., kerosene, can be prepared for ease of handling.

Nucleator For Wax Crystallization

The nucleator for wax crystallization is an aliphatic copolymer material which is soluble in the distillate at temperatures above the saturation temperature of the "waxy" components of said distillate but on cooling of the distillate progressively separates out as the temperature of the distillate approaches the saturation point of said "waxy" components, i.e., the distillate is cooled from a point slightly above (e.g., 10° F. above, preferably about 5° F. above) to a temperature below said saturation temperature. The term "saturation temperature" is defined at the lowest temperature at which the crystallization of the solute, i.e. petroleum waxes, cannot be initiated even if crystallization inducement methods are used.

Thus a wax nucleator raises the temperature at which the onset of wax crystallization from said distillate oil (e.g. fuel oil) occurs during cooling and is soluble in said oil at temperatures above the saturation temperature of said wax in said oil, but begins to separate out from said oil as the oil temperature approaches that of said saturation temperature.

Preferred among the polymeric wax nucleators are ethylene copolymers with a polymethylene backbone which is divided into segments by hydrocarbon, halogen, or oxy side chains, (usually prepared by free radical polymerization which might result in some branching) and comprises about 3 to 500, preferably 4 to 100, molar proportions of ethylene per molar proportion of an ethylenically unsaturated ester monomer (or mixture of unsaturated esters). An optimal polymer is a copolymer of ethylene with 2.0 to 12 mole % of vinyl acetate. These copolymers will generally have a molecular weight ($\overline{M}n$) in the range of from about 500 to 50,000, preferably about 1500 to about 30,000.

These unsaturated ester monomers, copolymerizable wtih ethylene, are the vinyl esters of $C_1$ to $C_{18}$ monocarboxylic acids, preferably $C_2$ to $C_5$ monocarboxylic acids, of the general formula:

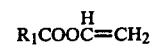

wherein: $R_1$ is hydrogen or a $C_1$ to $C_{17}$, preferably a $C_1$ to $C_8$, e.g. $C_1$ to $C_4$ straight or branched chain alkyl group. Examples of such esters include vinyl acetate, vinyl isobutyrate, vinyl laurate, vinyl myristate, vinyl palmitate, etc.

These preferred ethylene copolymers are readily produced by conventional polymerization methods using a free radical initiator as in U.S. Pat. No. 3,048,479.

Other monomers that can be copolymerized with ethylene include $C_3$ to $C_{16}$ alpha monoolefins, which can be either branched or straight chain, such as propylene, isobutene, n-octene-1, isooctene-1, n-decene-1, dodecene-1, etc. Still other monomers include vinyl chloride (although essentially the same result can be obtained by chlorinating polyethylene, e.g., to a chlorine content of about 10 to 35 wt. %), acrylonitrile, acrylamide, etc. The copolymerization is conventionally obtained using free radical initiators, Ziegler-Natta catalysts, etc.

The preferred ethylene copolymers can be formed as follows: solvent, and 5–50 wt. % of the total amount of monomer charge other than ethylene are charged to a stainless steel pressure vessel which is equipped with a stirrer. The temperature of the pressure vessel is then brought to the desired reaction temperature, e.g., 70° to 200° C., and pressured to the desired pressure with ethylene, e.g., 700 to 25,000 psig, usually 900 to 7,000 psig. The initiator, usually dissolved in solvent so that it can be pumped, and additional amounts of the monomer charge other than ethylene, e.g. the vinyl ester, can be added to the vessel continuously, or at least periodically, during the reaction time. Also during this reaction time, as ethylene is consumed in the polymerization reaction, additional ethylene is supplied through a pressure controlling regulator so as to maintain the desired reaction pressure fairly constant at all times. Following the completion of the reaction, usually a total reaction time of ¼ to 10 hours will suffice, the liquid phase is discharged from the reactor and solvent and other volatile constituents of the reaction mixture are stripped off leaving the copolymer as residue. To facilitate handling and later oil blending, the polymer is dissolved in a light mineral oil to form a concentrate usually containing 10 to 60 wt. % of copolymer.

Usually, based upon 100 parts by weight of copolymer to be produced, about 50 to 1200, preferably 100 to 600 parts by weight of solvent, usually a hydrocarbon solvent such as benzene, hexane, cyclohexane, a nonhydrocarbon solvent, such as t-butyl alcohol, etc., and about 1 to 20 parts by weight of initiator will be used.

The initiator is chosen from a class of compounds which at elevated temperatures undergo a breakdown yielding radicals, such as peroxide or azo-type initiators, including the acyl peroxides of $C_2$ to $C_{18}$ branched or unbranched carboxylic acids, as well as other common initiators. Specific examples of such initiators include dibenzoyl peroxide, di-tertiary butyl peroxide, t-butyl perbenzoate, t-butyl peroctoate, t-butyl hydroperoxide, alpha, alpha', azodiisobutyronitrile, dilauroyl peroxide, etc. Dilauroyl peroxide is preferred when the polymer is made at a low temperature, e.g., 70° to 135° C., while di-tert. butyl peroxide is preferred at higher polymerization temperatures.

Oil-Soluble Succinamic Acid and Derivatives Thereof

The second component of these flow improvers for distillate oils are oil-soluble succinamic acid or its derivative of the general formula

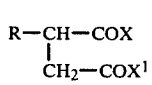

wherein: R is a straight chain aliphatic hydrocarbon group having from 0 to 1 site of olefinic unsaturation (alkyl or alkenyl) attached at a secondary carbon atom to the succinyl group and is of at least 8 carbon atoms, generally in the range of 14 to 28 carbon atoms and more usually in the range of 15 to 22 carbon atoms; one of X and $X^1$ is hydroxyl and the other is $$-NYY^1$$

wherein N has its normal meaning of nitrogen and Y and $Y^1$ are aliphatic hydrocarbyl groups of from 8 to 28 carbon atoms, more usually of from 14 to 22 carbon atoms, having a total of from about 30 to 52 carbon atoms, more usually of from 32 to 48 carbon atoms, and, preferably, of from 32 to 40 carbon atoms and the other of X and $X^1$ is of the formula:

$$-OH(NHY^2Y^3)_n$$

wherein n varies from 0 to 1, $Y^2$ and $Y^3$ are selected from the class of hydrogen, aliphatic hydrocarbon of from 1 to 30 carbon atoms and oxyaliphatic hydrocarbon of from 1 to 30 carbon atoms, and $Y^2$ and $Y^3$ may be taken together with the nitrogen to which they are attached to form a heterocyclic ring of from 5 to 7 annular members.

Y and $Y^1$ are aliphatically saturated and generally free of acetylenic unsaturation although each may have 1 to 2 sites of olefinic unsaturation, Y and $Y^1$ may be the same or different and may be straight chain or branched chain, preferably straight chain. The branches will normally be not greater than 1 carbon atom, i.e. methyl. The position of attachment to nitrogen may be at a terminal or internal carbon atom.

As is evidenced from the above formula, it is not important which position the alkyl or alkenyl group has in relation to the carboxamide or carboxyl group. Because of the bulky nature of the amine, the usual method of preparation through the succinic anhydride will provide the alkyl or alkenyl group beta to the carboxamide as the major product. To the extent that this is the more easily accessible derivative, this derivative is preferred. However, as far as operability is concerned, either isomer or a mixture of the two isomers may be used.

Individual compounds or mixtures of compounds may be used as pour point depressants. Mixtures of different C- and/or N-substituents, both as to homologs and isomers, will frequently be employed when the individual precursors to the succinamic acid product are not readily available.

Illustrative succinamic acids include N,N-dihexadecyl hexadecylsuccinamic acid, N-hexadecyl, N-octadecyl-octadecylsuccinamic acid, N,N-dihexadecenyl $C_{15-20}$-alkenylsuccinamic acid, N-hexadecenyl N-eicosenyl octadecylsuccinamic acid, N,N-diotadecenyl $C_{16-18}$-alkenylsuccinamic acid, etc.

As indicated previously, the succinamic acid may be used as its amine salt, preferably as a mixture of acid and amine salt.

The amine salt or acid or mixtures thereof can be represented by the following formula:

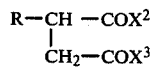

wherein R is as previously defined, one of the $X^2$ and $X^3$ is $-NYY^1$ wherein Y and $Y^1$ have been previously defined. The other of $X^2$ and $X^3$ is of the formula:

$$-OH(NHY^2Y^3)_n$$

wherein $Y^2$ and $Y_3$ may be hydrogen, aliphatic hydrocarbon of from 1 to 30 carbon atoms or oxaliphatic hydrocarbon (there being 1 ethereal oxygen atom present in the radical bonded to nitrogen at least B to the nitrogen atom) of from 3 to 30 carbon atoms, and $Y^2$ and $Y^3$ may be taken together to form a heterocyclic ring of from 5 to 7 members having nitrogen and oxygen as the only heteromembers, n varies from 0 to 1, preferably from 0.1 to 0.9. That is, from 10 to 90 mole percent of the succinamic acid present is in the form of its salt.

The aliphatic hydrocarbon groups may be saturated or unsaturated usually having not more than one beta sites of ethylenic unsaturation. The total number of carbon atoms for $HNY^2Y^3$ will be from 0 to 60, usually 1 to 40.

The groups indicated for Y and $Y^1$ may also be used for $Y^2$ and $Y^3$. However, as already indicated, primary amines may be used as well as secondary amines to form the salt. Usually, where an amine other than the one used to prepare the succinamic acid is used to form the salt, as will be explained subsequently, there will be a mixture of salts; both the added amine and the secondary amine employed to prepare the succinamic acid will be involved in salt formation.

Illustrative amines which may be used to form salts are di-sec.-butyl amine, heptyl amine, dodecyl amine, octadecyl amine, tert.-butyl amine, morpholine, diethyl amine, methoxybutylamine, methoxyhexylamine, etc.

The alkenyl succinamic acids of this invention are readily prepared by reacting an alkyl or alkenyl succinic anhydride with the desired secondary amine at a temperature in the range of about 65° to 125° C. in approximately equimolar amounts, either neat or in the presence of an inert solvent. The time for the reaction is generally in the range of 15 minutes to 1 hour. The reaction is well known in the art and does not require extensive discussion here.

The alkyl or alkenyl succinic anhydride which is used may be individual compounds or mixtures of compounds. That is, various alkyl or alkenyl groups of differing number of carbon atoms or different positions of attachment to the succinic anhydride group may be used. Alternatively, a single isomer may be used. Since mixtures are generally more readily available, to that degree they are preferred. Frequently, mixtures will be used of aliphatic hydrocarbyl substituted succinic anhydrides wherein no single homolog is present in amount greater than 25 mole percent.

Various secondary amines may be used, both those having the same aliphatic hydrocarbon groups and those having different aliphatic hydrocarbon groups. Either alkyl or alkenyl substituents may be present on the nitrogen, each having at least 14 carbon atoms. The range of difference between the two aliphatic hydrocarbon groups bonded at the nitrogen is not critical but will generally be fewer than 8 carbon atoms, more usually fewer than 6 carbon atoms. For most part, the aliphatic hydrocarbon groups will be straight chain, i.e. normal with the amino nitrogen bonded either to internal or terminal carbon atoms.

It is believed that when using about a 1:1 to 2:1 mole ratio of amine to succinic anhydride, depending on the reaction conditions, one or more of the following compounds may be present: alkyl succinamic acid; an amine salt of said acid; and, an amide of said acid.

If the above reaction is carried out with water present at the beginning, the first reaction which could occur will be that of forming alkyl succinic acid. In this instance, in the presence of the amine reactant, an additional compound, i.e., the diamine salt of the alkyl succinic acid, can also be present in the product.

The amine salts are readily prepared by adding the amine to the succinamic acid, conveniently as prepared, or in an inert solvent. Mild heating may facilitate the reaction.

Particularly effective is the above-described composition wherein the amine employed is hydrogenated di(-tallow) amine.

The distillate hydrocarbon oils which are treated with the additive package of this invention are wax-containing distillate petroleum oils boiling in the range of 120° to 500° C., preferably middle distillates boiling from about 150° C. to 400° C.

The invention is particularly effective for the cold flow treatment of high end point fuels which are nonresponsive to conventional flow improvers, i.e. those fuels having a final boiling point above about 370° C. (ASTM-1160).

The combination of the invention may be used alone or in combination with still other oil additives, e.g., corrosion inhibitors; antioxidants, sludge inhibitors, etc.

The invention will be further understood by reference to the following examples which include preferred embodiments of the invention.

EXAMPLES

The following materials were used:

Polymer 1

Polymer 1 is a copolymer of ethylene and vinyl acetate containing about 9 wt. % vinyl acetate and having a number average molecular weight ($\overline{M}_n$) of 4100 and a specific viscosity* at 38° C. of 0.37.

Polymer 2

Polymer 2 is a copolymer of ethylene and vinyl acetate containing about 38 wt. % vinyl acetate and having a ($\overline{M}_n$) of about 1800 and a specific viscosity* at 38° C. of 0.13. All number average molecular weights reported herein are determined by vapor phase osmometry (VPO).

Polymer 3

Polymer 3 is a copolymer of ethylene and vinyl acetate contaning about 16 wt. % vinyl acetate and having a ($\overline{M}_n$) of about 3000 and a specific viscosity* at 38° C. of 0.24 (all viscosities* measured at 1% concn. in mixed xylenes).

Succinamide A

Succinamide A was the principal ingredient of a commercial product identified as Oronite 410 sold by Chevron Chemical Co. of San Francisco, CA which is believed to be at least 60 wt. % alkenyl succinamide and succinamic amine salt obtained by reaction of equimolar amounts of $C_{15}$–$C_{22}$ alkenyl succinic acid and di-tallow ($C_{16\ ave.}$) amine and the balance of said Oronite 410 appears to be 5–10 wt. % of a copolymer of ethylene and isobutyl acrylate containing about 40 wt. % acrylate and diluent materials.

The commercial product and its ingredients may be prepared according to U.S. Pat. Nos. 3,444,082 and 3,544,467.

The Fuel

The properties of the middle distillate fuel tested is summarized in Table I which follows:

Table I

| | Distillate Fuel |
|---|---|
| Cloud Point, ° C. | 0 |
| n-Paraffin Range, Carbon No. | 10–32 |
| Distillation, ° C. (per ASTM-D-1160) | |
| IBP | 161 |
| 5% | 194 |
| 50% | 276 |
| 95% | 398 |
| FBP | 403 |

Blending of the polymer, polymer mixture, succinamide and succinamide-polymer mixture was accomplished by dissolution into the fuel oil. This was done while warming, e.g., heating the oil and additive to about 90° C. if the additive or additives per se was added, and stirring. In other cases, the additive was simply added with stirring to the fuel in the form of an oil concentrate which was usually about 50 wt. % active ingredient dissolved in a light mineral oil.

The blends were then tested for their cold flow properties in the tests described below.

The Cold Filter Plugging Point Test (CFPPT)

The cold flow properties of the blend were determined by the Cold Filter Plugging Point Test (CFPPT). This test is carried out by the procedure described in detail in "Journal of the Institute of Petroleum" Volume 52, Number 510, June 1966 pp. 173–185. In brief, a 40 ml. sample of the oil to be tested is cooled by a bath maintained at about −34° C. Periodically (at each one degree Centigrade drop in temperature starting from 2° C. above the cloud point) the cooled oil is tested for its ability to flow through a fine screen in a time period. This cold property is tested with a device consisting of a pipette to whose lower end is attached an inverted funnel positioned below the surface of the oil to be tested. Stretched across the mouth of the funnel is a 350 mesh screen having an area of about 0.45 square inch. The periodic tests are each initiated by applying a vacuum to the upper end of the pipette whereby oil is drawn through the screen up into the pipette to a mark indicating 20 ml. of oil. The test is repeated with each one degree drop in temperature until the oil fails to fill the pipette within 60 seconds. The results of the test are reported as the temperature in ° C. at which the oils fail to fill the pipette in the prescribed time.

The blends prepared and the test results are summarized in Table II which follows:

TABLE II

EFFECTIVENESS OF ADDITIVES IN THE FUEL

| Example | Wt. % a.i. | Additive | CFPPT° C. |
|---|---|---|---|
| 1 | — | none | −1 |
| 2 | 0.01% | Polymer 2 | −3 |
| 3 | 0.005 | Polymer 1 | −8 |
| | 0.005 | Polymer 2 | |
| 4 | 0.012 | Succinamide A* | −2 |
| 5 | 0.006 | Succinamide A* | −3 |
| | 0.005 | Polymer 2 | |
| 6 | 0.008 | Succinamide A* | −9 |
| | 0.003 | Polymer 1 | |

*introduced as Oronite 410 containing about 60 wt. % Succinamide A.

The enhanced results obtained by the teachings of this invention are apparent from the foregoing Table II if a comparison is made between Example 5 (approximates an alternative mixture to the mixture of Copolymer A and Example I of Table IV and Example I of Table IV set forth in U.S. Pat. No. 3,444,082) with a CFPPT ° C. value of −3 and the CFPPT ° C. value of Example 6 (the practice of the disclosure set forth herein). The comparison indicates that in fuels that are less responsive to the combinations set forth by the prior art the utilization of a nucleator for wax crystallization of said distillate fuel in combination with an oil-soluble succinamide derivative as disclosed in U.S. Pat. Nos. 3,444,082 and 3,850,587 surprisingly lowers the CFPPT ° C. value.

The ethylenically unsaturated esters which may be readily copolymerized with ethylene to provide the preferred wax nucleators are selected from the group consisting of a vinyl ester of a $C_1$ to $C_7$ saturated fatty acid, and compounds of the formula:

$$CH_2{=}\overset{\overset{\displaystyle X}{|}}{C}{-}COOR$$

wherein: X is selected from the group consisting of hydrogen and $C_1$ to $C_7$ alkyl groups, and R is a $C_1$ to $C_{13}$ alkyl group and has a number average molecular weight (VPO) in the range of 500 to 50,000 and preferably containing in the range of 2.0 to 12 mole % of said unsaturated ester. Typically ethylenically unsaturated esters include vinyl acetate, vinyl propionate, vinyl butyrate, vinyl caproate, vinyl caprylate, vinyl caprate, methylacrylate, isobutyl acrylate, methyl methacrylate lauryl acrylate and $C_{13}$ oxoalkyl methacrylate.

The oil-soluble succinamide derivative of the inventive combination has the property of a wax growth arresting function in said distillate petroleum fuel oil which when added to said fuel oil lowers the temperature at which wax begins to crystallize from said oil during cooling.

The method of the invention providing for improving the low temperature flow properties of said distillate fuel oil can be carried out by the addition of a concentrate containing a diluent and 1 to 60, preferably 5 to 60 wt. % of the combination of said polymeric nucleator and said succnamide derivative. The diluent is usefully mineral oil.

The nucleating activity of the oil-soluble aliphatic copolymer e.g. the ethylene-vinyl acetate copolymer is illustrated in Table V of U.S. Pat. No. 3,961,916.

It is to be understood that the examples in the foregoing specification are merely illustrative of this invention and not to be limited by any theory regarding its operability. The scope of the invention is to be determined by the appended claims.

What is claimed is:

1. A fuel oil comprising a major proportion of a middle distillate fuel oil containing n-paraffin wax which crystallizes from said oil during cooling, said fuel oil being improved in its low temperature flow and filterability by the incorporation of about 0.001 to 0.5 weight % of an oil-soluble flow and filterability improver composition comprising:

(a) 1 to 20 parts by weight of a synthetic polymer having the property of a wax nucleator in said oil which raises the temperature at which the onset of wax crystallization from said oil occurs during cooling, said nucleator being soluble in said oil at temperatures substantially above the saturation temperature of said wax in said oil, but which begins to crystallize from the oil as the oil is cooled towards said saturation temperature, said synthetic polymer comprising a copolymer of a major amount by weight of ethylene and in the range of about 9 to 16 wt. % vinyl acetate, said copolymer having a number average molecular weight (VPO) in the range of 500 to 50,000; and (b) 1 to 100 parts by weight of an oil-soluble succinamic acid or its derivative having the property of a wax growth arresting function in said distillate which when added to said fuel oil lowers the temperature at which wax begins to crystallize from said oil during cooling, said acid or its derivative having the following formula $$R{-}\underset{\underset{\displaystyle CH_2{-}COX^1}{|}}{CH}{-}COX$$

wherein: R is a straight chain aliphatic hydrocarbon group having from 0 to 1 site of olefinic unsaturation (alkyl or alkenyl) attached at a secondary carbon atom to the succinyl group and is of 8 carbon atoms to 28 carbon atoms; one of X and $X^1$ is hydroxyl and the other is $-NYY^1$ wherein N has its normal meaning of nitrogen and Y and $Y^1$ are aliphatic hydrocarbyl groups of from 14 to 28 carbon atoms and having a total of from about 30 to 52 carbon atoms and the other of X and $X^1$ is of the formula:

$OH(NHY^2Y^3)_n$ wherein n varies from 0 to 1, $Y^2$ and $Y^3$ are selected from the class of hydrogen, an aliphatic hydrocarbon of from 1 to 30 carbon atoms and an oxyaliphatic hydrocarbon of from 1 to 30 carbon atoms, and $Y^2$ and $Y^3$ may be taken together with the nitrogen to which they are attached to form a heterocyclic ring of from 5 to 7 annular members.

2. A wax-containing distillate petroleum fuel oil boiling in the range of 120° to 500° C. which has been improved in its low temperature flow properties, containing in the range of about 0.001 to 0.5 wt. %, based on the weight of the total composition, of a flow improving combination of (a) 1 to 20 parts by weight of an oil-soluble aliphatic copolymer functioning as a nucleator for wax crystallization in said distillate wherein said nucleator is a copolymer of ethylene with vinyl acetate containing 9 to 16 wt. % ester and having a number average molecular weight within the range of about 1500 to 30,000 and (b) 1 to 100 parts by weight of an oil-soluble succinamic acid or its derivative having the following formula

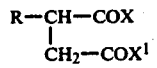

wherein: R is a straight chain aliphatic hydrocarbon group having from 0 to 1 site of olefinic unsaturation (alkyl or alkenyl) attached at a secondary carbon atom to the succinyl group and is of 8 carbon atoms to 28 carbon atoms; one of X and $X^1$ is hydroxyl and the other is $-NYY^1$ wherein N has its normal meaning of nitrogen and Y and $Y^1$ are aliphatic hydrocarbyl groups of from 14 to 28 carbon atoms and having a total of from about 30 to 52 carbon atoms and the other of X and $X^1$ is of the formula:

$OH(NHY^2Y^3)_n$ wherein n varies from 0 to 1 and $Y^2$ and $Y^3$ are selected from the class of hydrogen and an aliphatic hydrocarbon of from 14 to 28 carbon atoms.

* * * * *